United States Patent [19]

Carver

[11] 4,031,381

[45] June 21, 1977

[54] ILLUMINATABLE UMBRELLA

[76] Inventor: Phyllis Carver, 1815 Allison Road, Vancouver 8, British Columbia, Canada

[22] Filed: Mar. 8, 1976

[21] Appl. No.: 664,932

[52] U.S. Cl. ..... 240/6.42; 135/DIG. 10

[51] Int. Cl.[2] ..... F21V 33/00

[58] Field of Search ..... 240/6.42, 2 R; 135/DIG. 10

[56] References Cited

UNITED STATES PATENTS

| | | | |
|---|---|---|---|
| 1,166,272 | 12/1915 | Smithing | 240/6.42 |
| 2,235,864 | 3/1941 | Brennan et al. | 240/6.42 |
| 2,372,471 | 3/1945 | Campbell | 135/DIG. 10 |
| 2,507,919 | 5/1950 | Mazzeo | 135/DIG. 10 |

*Primary Examiner*—Richard L. Moses
*Attorney, Agent, or Firm*—Joel Halpern

[57] ABSTRACT

An umbrella adapted to be illuminated selectively when in its open position. A hollow tubular shaft supports the umbrella hood by means of a hub slidably mounted on the shaft. The hub carries an electrical conductor cooperable with electrical contacts in the bulb circuit and with the switch preventing illumination of the bulb unless the hood is open and then only by means of the switch.

4 Claims, 2 Drawing Figures

ILLUMINATABLE UMBRELLA

BACKGROUND OF THE INVENTION

The present invention relates to umbrellas carrying lighting means which are switch operable.

The hazards inherent in the crossing of thoroughfares at night or during inclement weather are well known. Pedestrians are frequently not seen by motorists during rainstorms and they are sometimes struck by the vehicle because of the poor visibility conditions thus encountered. It has been thought that the provision of a signalling light on an umbrella would attract attention to the pedestrian and thereby minimize the occurrence of such accidents. A number of umbrella constructions in which signalling lights have been incorporated have been known heretofore. U.S. Pat. No. 3,313,929 issued Apr. 11, 1967 to E. L. Schiavone illustrates an illuminated umbrella which is intended for use as a lawn or beach umbrella and U.S. Pat. No. 3,777,136 issued Dec. 4, 1973 to Shigekazu Okuda discloses an umbrella having an electric lamp and intended to increase pedestrian safety. However, prior umbrella constructions of the character described have been deficient in that apertures in the hollow tubular shaft of the umbrella has served as a means for the introduction of water which has on occasion caused corrosion and failure at the electrical contacts. Also, such umbrellas often attracted young children who would play with the umbrella as if it were a toy. The batteries and bulbs would be run down, and when used in the circumstances for which they were intended the umbrellas frequently did not function as designed because of either a worn out bulb or battery.

SUMMARY OF THE INVENTION

It is one object of the invention to provide an illuminatable umbrella constructed such that it may only be selectively illuminated when in an open position.

It is another object of the invention to provide an illuminatable umbrella which can only be illuminated while in an open condition and of such construction that certain of the electrical contacts are located externally of the umbrella shaft so as to be accessible for visual inspection and easy maintenance.

Other objects and advantages of the invention will become readily apparent from the following description of the invention.

According to the present invention there is provided an illuminatable umbrella comprising:

- a hollow tubular shaft;
- a hub slidably mounted on said shaft and having electrical conductor means on an inner portion thereof, said hub pivotably carrying a plurality of rib elements which support an umbrella hood;
- means for mounting an electric bulb at one end of said shaft;
- at least one battery mounted within said hollow shaft;
- a manually operable electric switch carried by said shaft;
- electrical conductor elements positioned within said shaft connecting said switch, batteries and bulb in a series circuit;
- and a pair of electrical contacts interposed in said series circuit adjacent the external surface of said shaft cooperable with said electrical conductor means on said hub, whereby upon engagement of said contacts by said electrical conductor means said switch can be manipulated to selectively energize said bulb.

BRIEF DESCRIPTION OF THE DRAWINGS

In order that the invention may be more fully understood it will now be described, by way of example, with reference to the accompanying drawings in which.

DETAILED DESCRIPTION OF THE INVENTION

Figures 1, 2:
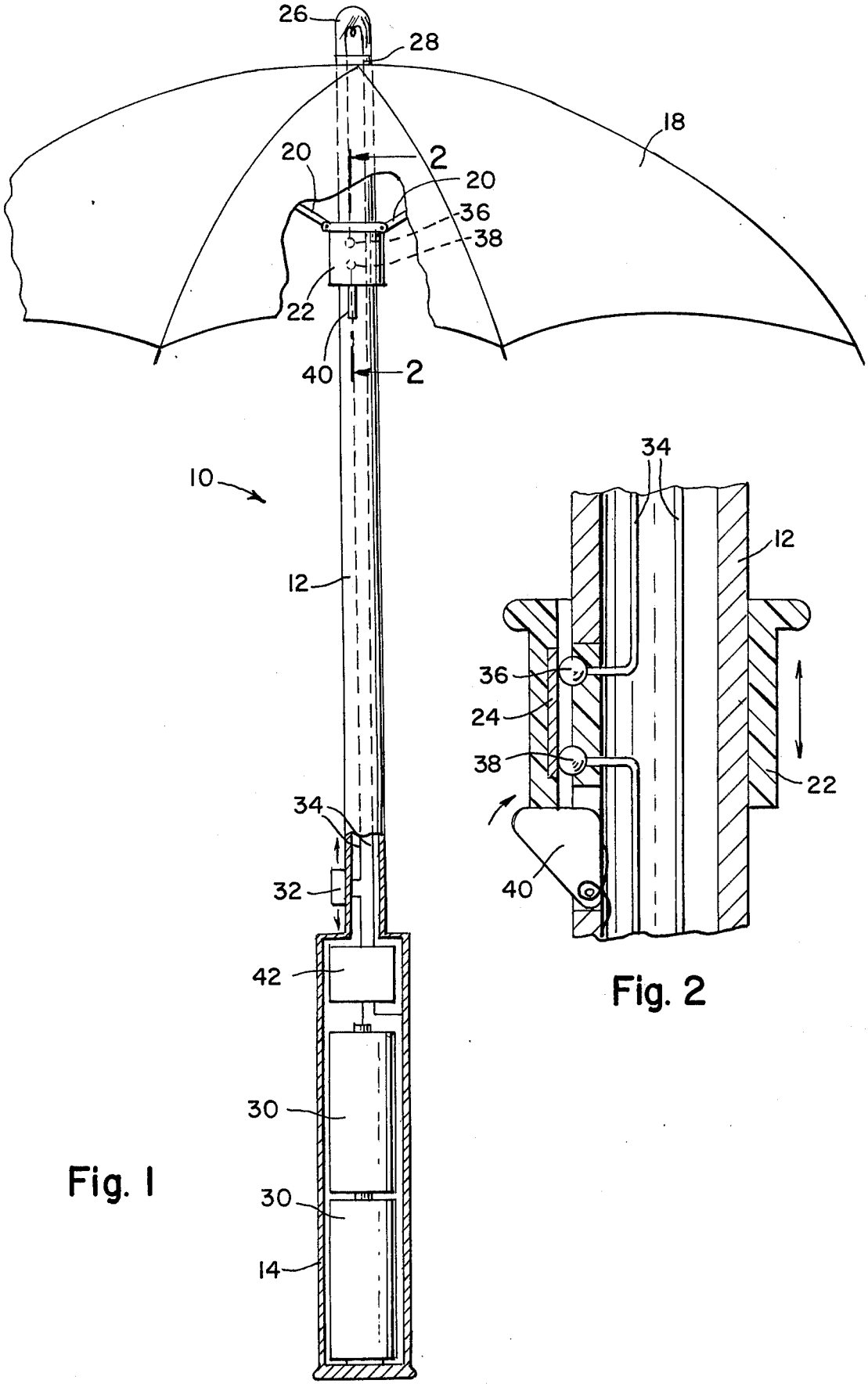
FIG. 1 is a side elevational view of an illuminatable umbrella, partly in cross-section, embodying the features of the invention.
FIG. 2 is an enlarged fragmentary view in cross section, of the hub or runner construction of the umbrella shown in FIG. 1 taken along line 2—2 thereof.

Referring to the drawings there is shown generally an illuminatable umbrella 10. The umbrella includes an elongated hollow shaft 12 having a handle section 14 and an upper portion which supports the umbrella hood 18 in a conventional manner. The rib elements 20 which are supportive of the hood are carried pivotably by a runner or hub member 22. An inner portion of the hub is provided with an electrically conductive surface for a purpose which will be described. However, it is to be understood that the entire hub may, if desired, be formed of a material which is electrically conductive. Preferably, however, a strip 24 of such material is incorporated in a hub which is otherwise formed of an electrically non-conductive material.

The umbrella shaft 12 carries at the end remote from the handle section a bulb element 26. The bulb may be mounted in an electrical socket 28 secured on the shaft. One or more batteries 30 are positioned within the hollow shaft for electrical connection with the bulb by means of a switch 32. Electrical conductors 34 extend within the shaft 12 connecting the batteries, bulb and switch in a series circuit. The series circuit is broken to provide a pair of electrical contacts 36, 38 which extend through the wall of the shaft and terminate adjacent the external surface thereof. Desirably such contacts terminate in ball contacts as shown most clearly in FIG. 2 which are sealingly mounted against the shaft. It will be appreciated that when the electrically conductive surface of the hub is in engagement with contacts 36, 38 switch 32 may be moved selectively to its "on" position to thereby energize the bulb 26. This is only possible, however, when the hub has been moved to the position shown in FIGS. 1 and 2 whereby the hood 18 is in its open condition.

A resilient latch element 40 is carried by the shaft so as to be normally biased outwardly of the shaft into the path of movement of hub 22. Thus, the latch serves to lock the hood in its open position. In such position the user of the umbrella can, if he so desires, manipulate switch 32 to its "on" position to thereby close the series circuit comprising the bulb, contacts 36, 38, the battery and the switch so as to cause the bulb to light. The bulb may be of the type which includes a bimetallic component which, upon the bulb filament heating to a predetermined temperature, breaks the internal bulb circuit and, upon cooling down of the filament, closes the bulb circuit again. Such bulbs are readily available on the market and result in an intermittently flashing light. As an alternative a flashing mechanism 42 may be included in the circuit to provide for a flashing signal. Since the incorporation of such flashing mechanism in a circuit of the type contemplated by the present invention is within the skill of the ordinary mechanic the circuit will not be described herein.

The latch element 40 is of the conventional type and may either be spring-biased or the element may comprise a wire spring element which has been deformed to fit within a slot in the hollow shaft 12 as is known.

From the foregoing it will be seen that an umbrella construction has been provided whereby a bulb mounted at the end of the umbrella shaft, preferably adapted to project a flashing signal, can be selectively switched on only when the umbrella is open. Thus, wear and tear on the batteries and the light bulb is minimized and the possibility of children running down either of such elements in substantially obviated. Further, the disposition of the conductor elements in the shaft leading to the contacts 36, 38 and to switch 32, which is conventional minimizes the exposure of such terminals to accumulations of water and moisture within the hollow shaft so as to reduce the possibility of electrical failure at such junctions. The electric circuit, except for the connection with switch 32 is maintained in a closed position by the positioning of hub 22 immediately above latch 40 by the spring-like action of the rib elements 20 acting on the upper portion of the hub and urging the hub against latch 40. Thus, the person carrying the umbrella can selectively operate the signal bulb through manipulation of switch 32 to open or close the remainder of the series circuit.

I claim:

1. An illuminatable umbrella comprising:

a hollow tubular shaft;

a hub slidably mounted on said shaft and having electrical conductor means on an inner portion thereof, said hub pivotably carrying a plurality of rib elements which support an umbrella hood;

means for mounting an electric bulb at one end of said shaft;

at least one battery mounted within said hollow shaft;

a manually operable electric switch carried by said shaft;

electrical conductor elements positioned within said shaft connecting said switch, batteries and bulb in a series circuit;

and a pair of electrical contacts interposed in said series circuit adjacent the external surface of said shaft cooperable with said electrical conductor means on said hub, whereby upon engagement of said contacts by said electrical conductor means said switch can be manipulated to selectively energize said bulb.

2. An illuminatable umbrella according to claim 1, wherein a resilient latch element is mounted on said hollow shaft normally biased outwardly into the path of movement of said hub to thereby maintain the electrical conductor means of said hub in engagement with said electrical contacts when the umbrella hood is in its open condition.

3. An illuminatable umbrella according to claim 1, wherein said pair of electrical contacts comprise ball contacts interposed between said hub and said shaft and sealingly engaging said shaft.

4. An illuminatable umbrella according to claim 1, wherein said electric switch is mounted externally of said hollow shaft and is adapted to selectively close the series circuit connecting said batteries, bulb and electrical contacts when said hood is in its open position to thereby energize said bulb.

* * * * *